United States Patent [19]

Thomsen et al.

[11] Patent Number: 4,870,892

[45] Date of Patent: Oct. 3, 1989

[54] CONTROL MEANS FOR A HYDRAULIC SERVOMOTOR

[75] Inventors: Flemming Thomsen, Abenra; Harry S. Nissen; Kjeld Ravn, both of Sonderborg; Carl C. Dixen, Sonderborg, all of Denmark

[73] Assignee: Danfoss A/S, Nordborg, Denmark

[21] Appl. No.: 309,173

[22] Filed: Feb. 13, 1989

[30] Foreign Application Priority Data

Feb. 16, 1988 [DE] Fed. Rep. of Germany ..... 3804744

[51] Int. Cl.[4] ..... F15B 13/16

[52] U.S. Cl. ..... 91/361; 91/454; 91/459; 137/614.19; 251/129.05

[58] Field of Search ..... 91/361, 363 R, 365, 91/453, 454, 459, 461; 137/613, 614.19; 251/129.05

[56] References Cited

U.S. PATENT DOCUMENTS

| | | | |
|---|---|---|---|
| 3,608,435 | 9/1971 | Conabee et al. | 91/454 |
| 3,782,250 | 1/1974 | Kiszewski | 91/454 |
| 4,318,332 | 3/1982 | Shingu et al. | 91/454 |
| 4,440,066 | 4/1984 | Anderson | 91/459 |
| 4,628,499 | 12/1986 | Hammett | 91/361 |

FOREIGN PATENT DOCUMENTS

| | | | |
|---|---|---|---|
| 0152906 | 9/1983 | Japan | 91/454 |

*Primary Examiner*—A. Michael Chambers

*Attorney, Agent, or Firm*—Wayne B. Easton; Clayton R. Johnson

[57] ABSTRACT

A control system for a two way acting hydraulic servomotor wherein the servomotor is connected in the diagonal of a bridge circuit that includes four magnetic valves with a pair of the valves being normally open in a non-energized condition being connected to the one end of the servomotor and to the container and a second pair of the valves being normally closed in a deenergized condition being connected to the opposite end of the servomotor and to a pressure source. Circuitry provides pulse trains that are modulatable to control the operation of the magnetic valves and thereby the application of pressurized fluid to the opposite ends of the servomotor.

14 Claims, 2 Drawing Sheets

Figure 1:
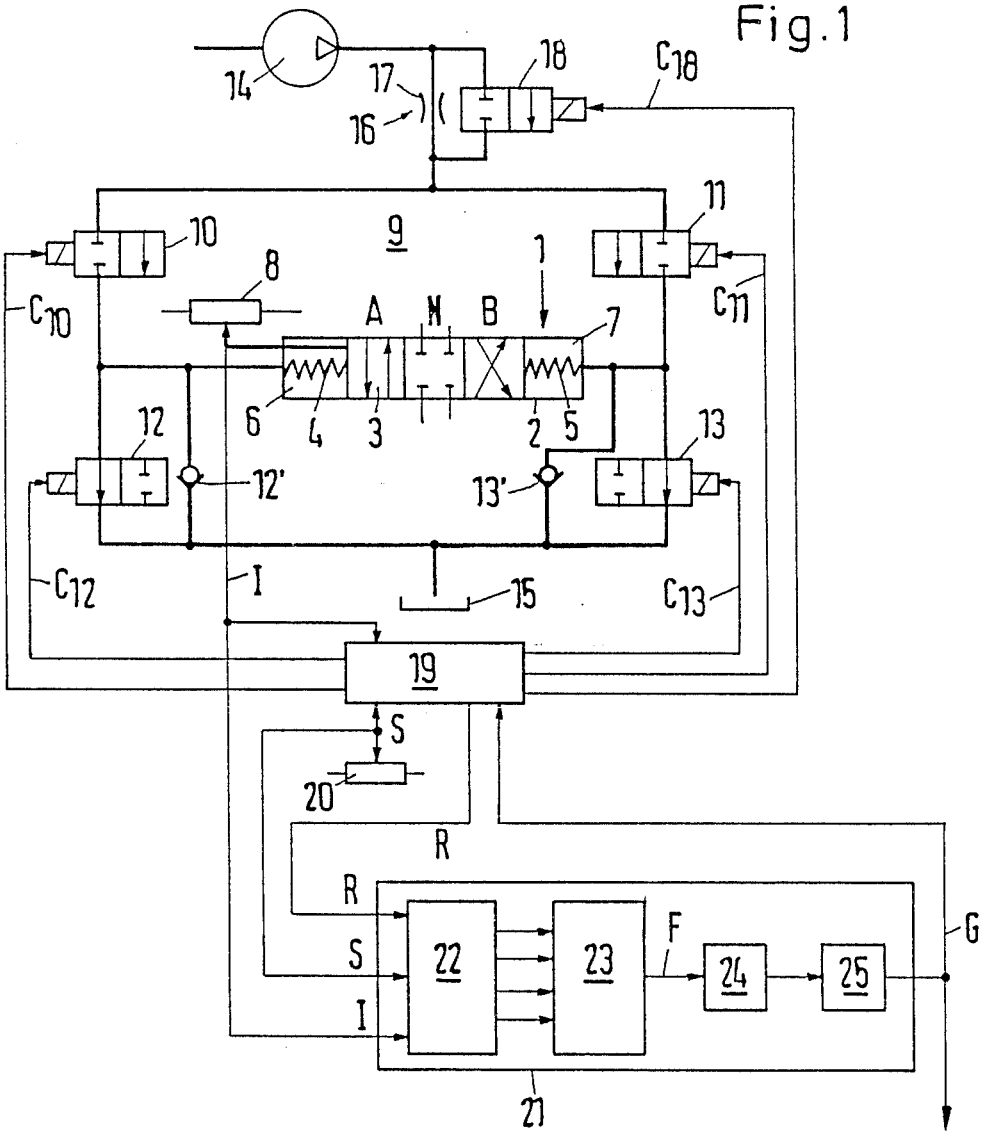

C10, C11
C12, C13
10,11
12,13
26
27
b
Z1
Z2
T
K1
K2
t1 t2 t3 t4 t5 t6 b'
27'
K'2
t7 t8 t9 t10

28
29
Z3
Z4
K3
K4
K5
P1
P2

CONTROL MEANS FOR A HYDRAULIC SERVOMOTOR

The invention relates to control means for a hydraulic servomotor, wherein two magnetic valves in series are operable with a time overlap to the open condition by two trains of control pulses.

In known control means of this kind (SE-AS 77 14 476-4), the piston-swept cylinder space of a servomotor loaded in the opposite direction by a spring is connected on the one hand to the pump by way of two magnetic valves in series and on the other hand to the container by way of two magnetic valves in series. Two pulse generators operate at the same frequency, one of these producing a fixed train of pulses with a fixed phase position and pulse duration whilst the other train of pulses is modulated in phase position or in pulse width. This leads to variable overlap at times in which both magnetic valves are energised and therefore open.

The invention is based on the object of obtaining good resolution and a high certainty of operation in control means of the aforementioned kind.

This problem is solved according to the invention in that the one magnetic valve is normally open and operable to the closed condition by the control pulses of the first train of pulses and that the other magnetic valve is normally closed and operable to the open condition by the control pulses of the second train of pulses.

A normally open magnetic valve which is held closed by being energised can be opened by a short control pulse gap and closed again without time delay because a rapid reaction is possible on account of the residual magnetism available on commencement of the next control pulse. This is in contrast with normally closed magnetic valves in which, at the end of the control pulse required for the opening, the magnetic field first has to be reduced again before closing takes place. Accordingly, the passage of very small amounts of pressure medium can be exactly controlled solely by operating the normally open magnetic valve, and this produces the desired resolution. By reason of the fact that a normally open magnetic valve is combined with a normally closed one, one obtains the certainty that the flow of pressure medium is in any case interrupted when there is no current.

Desirably, the pulse width of at least the first train of pulses is modulatable. In this way, one can reduce the control pulses down to the lower limit and allow the passage of correspondingly small amounts of pressure medium which lead to a correspondingly smaller adjustment of the servomotor.

In a preferred circuit, the first train of pulses constitutes an equal phase inversion of the second train of pulses. Consequently, only a single train of pulses needs to be produced and inverted, which considerably reduces the equipment and costs. Both magnetic valves are therefore operated simultaneously and opened. The pass time is, however, determined by the normally open magnetic valve which closes more rapidly.

A still further reduction in the amount passed through is obtained if the width of the pulse gap of the first train of pulses is modulatable to smaller values than the pulse width of the second train of pulses. This even enables the normally open magnetic valve to be closed again after partial opening whilst the normally closed magnetic valve goes through the full opening stroke.

In an alternative embodiment, pulses of smaller width of the first train of pulses are overlapped on both sides by pulses of larger width of the second train of pulses. In this case, parts of the pressure medium are allowed to pass at twice the switching frequency of the magnetic valves, which produces a high resolution at the same speed and a rapid response.

Here, the first train of pulses may constitute an inversion of the second train of pulses that is displaced in phase by half the cycle width. This likewise gives a very simple circuit.

In a preferred embodiment, the servomotor is disposed in the diagonal of a bridge circuit containing four magnetic valves, every pair of opposed magnetic valves forming for each direction of operation a series circuit which lies between the pressure source and the container. In this case, the magnetic valves can serve to close the two pressure spaces of the servomotor from the outside or to operate the servomotor in the one or other direction.

In this case, the normally open magnetic valves should be arranged in the bridge path on the container side. In the absence of current, no impermissible loads are exerted on the servomotor.

It is of particular advantage if the servomotor is loaded by neutral position springs and a check valve is connected in antiparallel to each normally open magnetic valve. In the absence of current, the servomotor automatically returns to the neutral position. The neutral position is maintained even if one of the normally closed valves should fail to close completely, for example because of soiling of the valve seat. Pressure fluctuations in the container will not overlap the servomotor because they are led through the check valves into both pressure spaces of the slide. Thus, in the absence of current, the container pressure could rise if more pressure fluid is returned to than is sucked from one of the control paths controlled by the servomotor.

It is also favourable if the two normally open magnetic valves are operable to the closed condition with a time overlap, the normally closed magnetic valves not been energised. In this way, during normal operation the servomotor can be returned to the neutral position in a controlled manner but without the supply of pressure medium.

In addition, a controllable throttle apparatus may be disposed between the pressure source and the bridge circuit. This throttle apparatus permits the amount of the supplied pressure medium to be limited so that the amount of pressure medium supplied to the servomotor when the magnetic valves are open can be kept lower. This likewise increases the resolution.

In particular, the throttle apparatus may comprise a fixed throttle which is bridged by a magnetic valve. In this way, throttling can be selectively made effective or ineffective by opening or closing the magnetic valve. If the magnetic valve is operated with energising pulses modulated in impulse width, the amount allowed to be passed can be set at will.

It has proved desirable for an impulse train to be modulatable depending on the controlled departure formed by the difference between a position desired value and a position existing value detected by a position sensor at the servomotor. In this way, the servomotor can accurately assume the desired position.

In this case, it is desirable that an error checking circuit comprises comparators for the existing value, the desired value and the control departure and a logic circuit for evaluating the results determined by the comparators and that the logic circuit delivers a neutral position signal when a predetermined combination of results occurs. On the occurance of a system error, the servomotor therefore returns to the neutral position.

It is advantageous if the neutral position signal is deliverable when the position desired value and the position existing value have different signs or when the absolute amount of the desired value is smaller than that of the existing value. This results in a particularly simple possibility of checking for system errors.

Figures 2A, 2B, 2C, 2D, 3A, 3B, 4A, 4B, 4C, 4D, 4E:
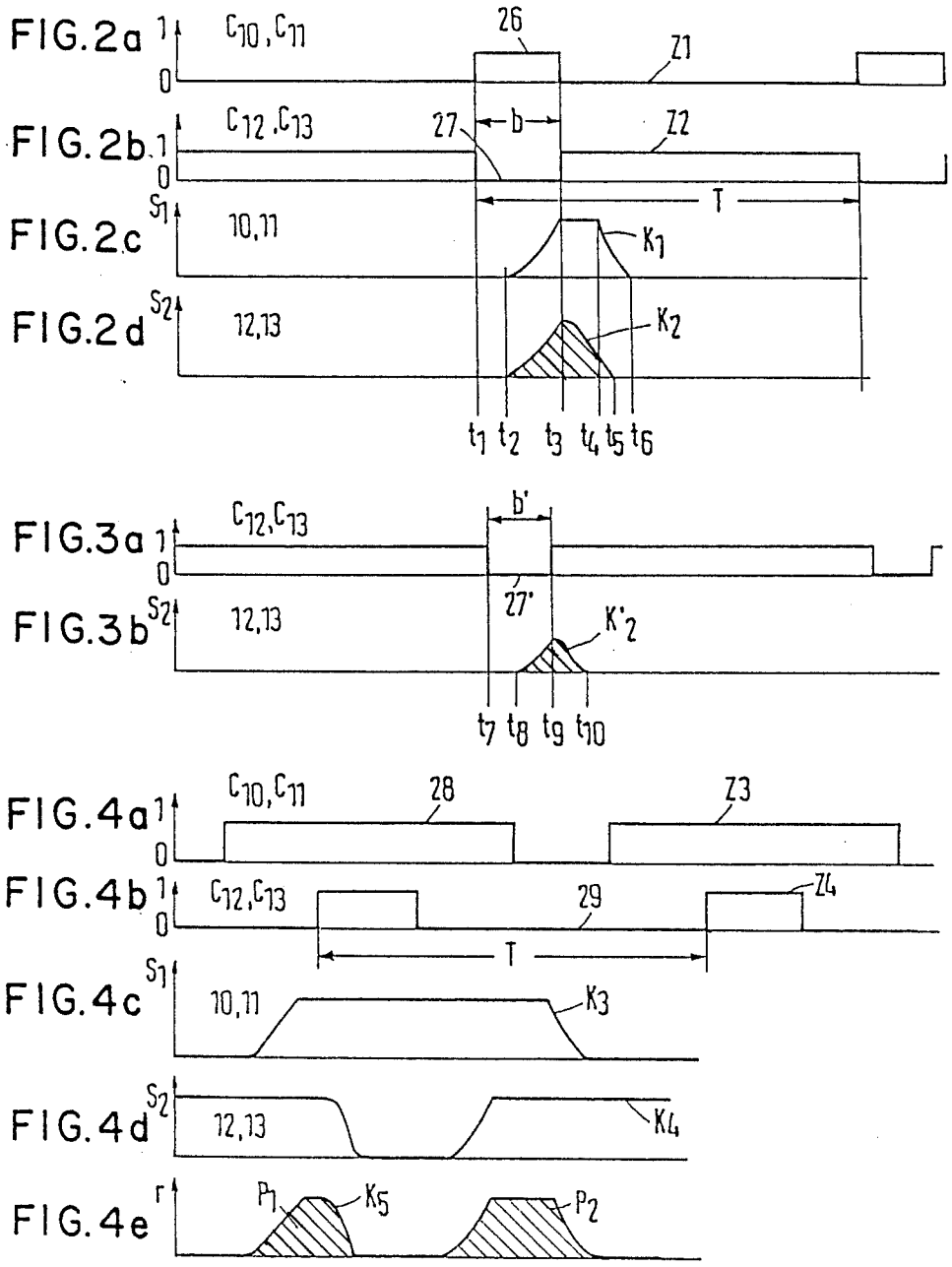

Preferred examples of the invention will now be described in more detail with reference to the drawing, wherein:

FIG. 1 is a circuit diagram of control means according to the invention,

FIG. 2*a–d* is a time graph for a first embodiment,

FIG. 3*a–b* is a time graph for a second embodiment, and

FIG. 4*a–e* is a time graph for a third embodiment.

In the control means according to FIG. 1, the servomotor 1 is in the form of a control valve for a consumer. It comprises a piston-like slide 3 which is movable in a housing bore 2 and which, under the influence of two neutral position springs 4, 5, can assume a central neutral position N and, after introducing pressure medium into one of the pressure chambers 6, 7, can assume an operating position A or B. The position of the slide 3 is detected by a position sensor 8 which is in the form of a potentiometer and delivers signals for the existing value I of the position.

The servomotor 1 is disposed in the diagonal of a bridge circuit 9 which has a magnetic valve 10, 11, 12 and 13 in each branch. The bridge circuit 9 is fed by a pressure source 14 such as a pump and is connected to a container 15 at the diagonally opposite end. The pump is in series with a controllable throttle apparatus 16 which consists of a fixed throttle 17 and a magnetic valve 18 which bridges same and is normally closed.

The two magnetic valves 10, 11 in the branch of the bridge circuit 9 on the pump side are of the normally (de-energised) closed type, i.e. they are opened by the supply of energising current. The magnetic valves 12, 13 in the bridge branch on the container side are of the normally (de-energised) open type, i.e. they are closed by the supply of energising current. In addition, they are bridged by check valves 12', 13'.

If the slide 3 is to be brought out of the neutral position N into the operating position A, the normally closed magnetic valve 11 and the normally open magnetic valve 12 are each supplied with width-modulated energising pulses whereas the magnetic valve 13 is closed. In the opposite direction of movement, the magnetic valves 10, 13 are operated when the magnetic valve 12 is closed. The check valves 12', 13' permit replenishment of the respective space 5 or 6 during return of the slide 3 to the neutral position N in the absence of current. In addition, they avoid overloading of the servomotor by container pressure fluctuations when the current fails because these fluctuations are led through the check valves into both pressure spaces of the slide.

Thus, in the absence of current, the container pressure could rise if more pressure fluid is returned than sucked from a control path controlled by the servomotor.

In addition to the signal for the existing value I, a regulator 19 is fed by a desired value generator 20 with a signal for the desired value S of the position of the servomotor 1. Depending on the control departure R, that is to say the difference between the desired value S and the existing value I, the individual magnetic valves 10 to 13 and possibly 18 are supplied with corresponding control signals C10, C11, C12, C13 and C18. All control signals are formed by pulses of the same frequency.

An error monitoring circuit 21 is supplied with signals for the existing value I, the desired value S and the control departure R. In a comparator circuit 22, there is a set of comparators which evaluate the three imput signals with regard to their value or their sign. In particular, it is determined with respect to the control departure R whether it departs from O and with regard to the existing value I, the desired value S and the control departure R whether they are positive or negative. A logic circuit 23 evaluates these results. If the control departure is O, it is assumed that the system operates efficiently because the position existing value I is equal to the position desired value S. However, if the existing value I and the desired value S have a different sign or if the absolute amount of the existing value I is larger than that of the desired value S, there will be a system error because the slide has moved opposite to the desired direction or beyond the absolute amount of the desired value. In this case, the logic circuit will deliver an error signal F.

If I, S and R all have the same sign, this means that the desired value S is larger than the existing value I. This means that an operation is required which is larger than that of which the servomotor is capable, probably because of a mechanical limit to the end position. In this situation, no system error is registered.

On the other hand, if I and S have the same sign and R the opposite sign, this means that the desired value S is numerically smaller than the existing value I and therefore the slide 3 has executed a larger displacement than is desired. This situation is registered as a system error.

The error signal F is fed to a delay element 24 which takes account of the fact that the desired value S could have a higher changing speed than the maximum slide speed. The delay element is followed by a memory element 25, for example a flip-flop, which retains the error signal even when the error disappears again. This memory element delivers a neutral position signal G which is fed to the regulator 19. The latter ensures that the servomotor 1 immediately returns to the neutral position N. This can, for example, take place in that the energising current of all magnetic valves is switched off, whereupon the slide 3 returns to the neutral position N under the influence of the neutral position springs 4, 5. However, there may also be a force control in that the pair of magnetic valves 10, 13 or 11, 12 is actuated in the correct sense. Thus, if an error occurs which is longer than the response time of the delay circuit 24, it is retained in the memory element 25 and it can only be manually removed again.

The neutral position signal G may also be returned to an indicating apparatus, e.g. a luminous diode, or to an external relay, for example for switching off the magnetic valves 10 to 13 or to relieve these magnetic valves from the control pressure.

The first two lines of FIG. 2 show that the four magnetic valves of the bridge circuit are fed by pulse trains 21, 22 with control pulses represented by the logic values 0 and 1, one of the pulse trains representing an equal phase inversion of the other pulse train. This can be brought about with a very simple circuit which merely modulates the one train of pulses with respect to width depending on the control departure R and then as an inversion stage for the second pulse train. The third line shows the opening paths S1 of the normally closed magnetic valves 10, 11 and the fourth line shows the opening paths S2 of the normally open magnetic valves 12, 13. At the instant t1, a pulse of the pulse train Z1 and a pulse gap of the pulse train Z2 commence. The two valves start the opening step at the instant t2 with the delay associated with the build up or reduction of the field. Full opening has been achieved at the instant t3. It is assumed that the pulse 26 and the pulse gap 27 just have a width b so that they finish at the instant t3. The open condition of the magnetic valves 10, 11 is now maintained up to the instant t4 whereas in the case of the magnetic valves 12, 13 the return movement takes place immediately by reason of the residual magnetism that is present, so that they are already closed at the instant t5. On the other hand, closure of the magnetic valves 10, 11 would only take place at the instant t6. This results in a characteristic opening line K1 for the normally closed magnetic valves 10, 11 as well as a characteristic opening line K2 for the normally open magnetic valves 12, 13.

The cross-hatched area under the line K2 are therefore an expression of the volumetric flow supplied to the servomotor. This amount can be adapted to the desired requirements by increasing or reducing the pulses 26 and the pulse gaps 27. The smaller the area, the larger will be the resolution with respect to the position of the servomotor 1.

With the aid of the normally open valves 12, 13, it is therefore possible to achieve smaller amounts of flow per unit time than with a normally closed valve.

The cycle time T may for example be 25 ms, which corresponds to a modulation frequency of 40 Hz.

According to FIG. 3, it is even possible to shorten the pulse gap 27' relatively to the pulse 26 with respect to time but it still remains within the pulse period so that the relevant valve 12 or 13 does not fully open but is forced to close again before this. This gives the characteristic line K2'. It leads to a still further reduced amount of flow of pressure medium.

In FIG. 3, the instant t7 of commencement of the pulse gap 27' lies somewhat behind the instant t1. Consequently the instant t8 on commencement of the opening movement of the magnetic valve 11 or 13 is after the instant t2. The instant t9 for the end of the pulse gap 27' coincides with the opening movement of the magnetic valve. Since the closing movement starts immediately thereafter, the magnetic valve is closed again at the instant t10 so that a very small volume is obtained per unit time.

In the embodiment of FIG. 4, the pulse train Z3 is an inversion of the pulse train Z4 but displaced in phase relatively thereto by half the cycle time T. The width of the pulse 28 therefore corresponds to the width of the pulse gap 29. In this case, the normally closed magnetic valve 10 or 11 has the characteristic opening line K3 whilst the normally open magnetic valve 12 or 13 has the characteristic opening line K4. Since flow can take place only when both magnetic valves are open, one obtains the resulting characteristic opening line K5 which corresponds to the actual flow per unit time. It will be seen that two pass pulses P1, P2 occur during each cycle T, which corresponds to a modulation frequency of 80 Hz although the magnetic valves are operated only with a frequency of 40 Hz. The pulse width difference modulation therefore leads to a better resolution at the same speed and to a more rapid response. One can also employ this manner of operation to achieve a lower operating frequency for the magnetic valves at the same modulating frequency, so that their life is prolonged.

It is not only the manners of operation that are possible which lead to the first displacement of the slide 3 in the one or other operating direction through operation of diagonally opposed magnetic valves 10, 13 or 11, 12. Instead, the slide 3 may also return to the neutral position N automatically under the influence of the neutral position springs 4, 5. This may be important when the current fails. The return motion may also be brought about at a certain speed by overlapping operation of the normally open magnetic valves 12, 13. Further, forced operation may also take place by way of the diagonally opposite magnetic valves 10, 13 or 11, 12. Upon a large control departure, operation is therefore preferably switched from a modulation control by means of the magnetic valves 12, 13 to control by means of the magnetic valves 10, 13.

The magnetic valve 18 can be set by the regulator 19 by closure or pulse width-modulated operation of the magnetic valve 18 such that only a throttled flow will take place through the throttle apparatus 16, which means that the effective amount of flow as illustrated below the characteristic lines K2, K2' and K5 can be reduced still further.

Many changes can be made to the illustrated examples without departing from the basic concept of the invention. For example, the desired value generator 20 need not be operated by hand; it can also be changed by a programme or by a computer. The control means may also be operated without the throttle apparatus 16. Instead of a control valve, the servomotor may also adjust other operating equipment or the like. It may operate linearly or by rotation.

We claim:

1. Control means for a hydraulic servomotor having a slide member and means resiliently retaining the slide member in a neutral position while permitting movement from the neutral position to a first operative position by application of fluid pressure to a first fluid chamber of the servomotor to extend into the servomotor second fluid chamber, comprising a source of pressurized fluid, a container, a first magnetic valve fluidly connected between the second chamber and container, a second magnetic valve fluidly connected between the source and the first chamber for controlling the application pressurized fluid from the source to the first chamber, the first valve being normally open in a de-energized condition, the second valve being normal closed in a de-energized condition, and energizing means for generating a first and a second train of control pulses and applying the pulses to the valves to open the valves for a timed overlap, the energizing means being connected to the first valve for applying the first train of pulses thereto to close the first valve and to the second valve for applying the second train of pulses thereto to control the opening of the second valve.

2. Control means according to claim 1 wherein the energizing means provides at least one the train of pulses with modulatable pulse widths.

3. Control means according to claim 1 wherein the engergizing means comprises means for providing the first train of pulses that constitues an equal phase inversion of the second train of pulses.

4. Control means according to claim 1 wherein the pulses of the first train have pulse gaps and the pulses of the second train have given pulse widths, characterized in that the energizing means comprises means that provide the first train pulses with gap widths that are modulatable to a lower value than the pulse widths of the second train of pulses.

5. Control means according to claim 1 wherein the energizing means comprises means for providing pulses of the first train that are of substantially smaller widths than the pulses of the second train and are overlappped on both sides by the pulses of the second train.

6. Control means according to claim 5 wherein the last mentioned means produces the first train pulses as constituting inversions of the second train pulses and displaced in phase by half cycle widths.

7. Control means according to claim 1 wherein the slide member is movable under pressure from the neutral position to a second operative position, characterized in a third magnetic valve is fluidly connected between the container and the connection of the second valve to the servomotor and a fourth magnetic valve is fluidly connected between the source and the connection of the first valve and the second chamber for controlling the application of pressurized fluid from the source to the second chamber, the third valve being a normally open in a de-energized condition and the fourth valve being normally closed in a de-energized condition, the third and fourth valves being controlled by the energizing means for moving the slide member from the neutral position to the second operative position.

8. Control means according to claim 7 wherein a first check valve means is fluidly connected in parallel to the third valve to permit fluid flow from the container to the first chamber and block fluid flow therethrough from the first chamber to the container and second check valve means is fluidly connected in parallel to the first valve means to permit fluid flow there-through from the container to the second chamber and block fluid flow therethrough from the second chamber to the container.

9. Control means according to claim 8 characterized in that the energizing means includes means for operating the first and third valves to a closed condition with a timed overlap when the second and fourth valves are de-energized.

10. Control means according to claim 8 wherein a controllable throttle device is fluidly connected between the pressure source and the connections of the second and fourth valves to the pressure source.

11. Control means according to claim 10, characterized in that the throttle device includes a fixed throttle and a fifth magnetic valve connected in parallel to the fixed throttle.

12. Control means according to claim 7 wherein the energizing means provides a third train of pulses to the third valve to close the third valve and a fourth train of pulses to the fourth valve to open the fourth valve, and includes sensor means for detecting a position existing value of the slide member and modulating the inpulse trains that depends on a controlled departure formed by the difference between a position desire value and the position selected value.

13. Control means according to claim 2 characterized in that there is provided an error checking circuit that comprises a set of comparators for evaluating the existing value, the desired value and control departure, and logic circuit means for evaluating the results determined by the set of comparators and delivering a neutral signal to the energizing means upon the occurance of a predetermined combination of results ascertained by the set of comparators.

14. Control mean according to claim 13 where in the logic circuit delivers the neutral circuit when upon one of the position desired value and position existing value have a different signal, and the absolute amount of the desired value is smaller than the existing value.

* * * * *